US005541561A

United States Patent [19]

Grunert et al.

[11] Patent Number: 5,541,561

[45] Date of Patent: Jul. 30, 1996

[54] INTEGRAL ELECTRICAL CIRCUIT CONTROLLER

[75] Inventors: Kurt A. Grunert; John A. Wafer, both of Beaver, Pa.

[73] Assignee: Eaton Corporation, Cleveland, Ohio

[21] Appl. No.: 161,040

[22] Filed: Dec. 3, 1993

[51] Int. Cl.[6] ..... H01H 67/02

[52] U.S. Cl. ..... 335/132; 335/16

[58] Field of Search ..... 335/16, 147, 195, 335/131, 202, 132

[56] References Cited

U.S. PATENT DOCUMENTS 5,268,661 12/1993 Grunert et al. ..... 335/16

FOREIGN PATENT DOCUMENTS

SE91/0076 8/1991 Sweden .

OTHER PUBLICATIONS

Klockner–Moeller Main Catalogue (HPL 90/91 GB, FLS/Br), pp. 9/1–9/28, published May 1990 in the Federal Republic of Germany.

*Primary Examiner*—Lincoln Donovan

*Attorney, Agent, or Firm*—Martin J. Moran

[57] ABSTRACT

An integral electrical circuit controller apparatus selectively connects a load to a power source and includes an electrical contactor having contacts, a circuit breaker having separable contacts connected in series with the electrical contactor and a trip mechanism responsive to current flowing through the separable contacts for tripping the contacts open in response to predetermined current conditions, and a current throttle impedance for limiting short circuit current. The trip mechanism and the electrical contactor independently interrupt current flowing through the electrical contactor and the circuit breaker. The current throttle impedance limits short circuit current flowing through the electrical contactor and the circuit breaker until current is interrupted. The electrical contactor may include an overload relay. The current throttle may include a coiled conductor of nichrome or iron wire enclosed in a dielectric housing. The coiled conductor may have a generally cylindrical shape and may be user-modifiable.

20 Claims, 11 Drawing Sheets

INTEGRAL ELECTRICAL CIRCUIT CONTROLLER

BACKGROUND OF THE INVENTION

1. Field of the Invention

This invention is directed to a circuit controller for protecting a load and a power circuit connected to the load, and more particularly to such an integrally packaged electrical circuit controller connected to a motor and having a contactor, a circuit breaker and a current throttle for providing current limiting protection.

2. Description of the Prior Art

A. CONTACTORS

Electromagnetic contactors are well-known in the art. A typical example may be found in U.S. Pat. No. 3,339,161 issued Aug. 29, 1967 to J. P. Conner et al. entitled "Electromagnetic Contactor" and assigned to the assignee of the present invention. Electromagnetic contactors are switch devices which are especially useful in motor-starting, lighting, switching and similar applications. A motor-starting contactor with an overload relay system is called a motor controller or starter.

A contactor usually has a magnetic circuit which includes a fixed magnet and a movable magnet or armature with an air gap therebetween when the contactor is opened. An electromagnetic coil is controllable upon command to interact with a source of voltage which may be interconnected with the main contacts of the contactor for electromagnetically accelerating the armature towards the fixed magnet, thus reducing the air gap. Disposed on the armature is a set of bridging contacts, the complements of which are fixedly disposed within the contactor case for being engaged thereby as the magnetic circuit is energized and the armature is moved. The load and voltage source therefor are usually interconnected with the fixed contacts and become interconnected with each other as the bridging contacts make with the fixed contacts.

Generally, as the armature is accelerated towards the magnet, it must overcome two spring forces. The first spring force is provided by a kickout spring which is subsequently utilized to disengage the contacts by moving the armature in the opposite direction when the power applied to the coil has been removed. As this occurs, the contacts are opened. The other spring force is provided by a contact spring which begins to compress as the bridging contacts abut the fixed contacts. The force of the contact spring determines the amount of electrical current which can be carried by the closed contacts, and furthermore determines how much contact wear is tolerable as repeated operation of the contactor occurs. It is usually desirous for the contact spring to be as forceful as possible, thus increasing the current-carrying capability of the contactor and increasing the capability to adapt for contact wear. However, since this force must be overcome by the energy provided to the electromagnet during the closing operation, more closing energy will generally be required for relatively stiffer contact springs than for less stiff contact springs.

The addition of an overload relay transforms a contactor into a starter or motor controller. The purpose of a thermal overload relay is to generate and sense heat produced by line current and "trip" (stop the motor) if the retained heat exceeds an acceptable level. The function of a conventional thermal overload relay in a starter is to generate heat in a heater using the current flowing to the motor and the resistance of the heater element. This heat is directed toward either a bimetal or eutectic alloy that "trips" and opens the starter under overload conditions.

The more heat generated in a starter, the greater the physical size required to dissipate the heat. Also, the more space must be left around the starter to avoid injurious effects to surrounding devices.

In traditional starters, heat is generated from three sources: (1) coil operation; (2) current through the contacts; and (3) overload relay heaters. Traditional starters have thus been improved in three ways: (1) low coil holding power reduces heating in the coil; (2) high contact force results in less heat generated in the contact set; and (3) current sensors, rather than heaters, eliminate most of the temperature rise in the overload relay.

In conventional starters, the limiting factor in establishing short circuit withstand ratings is primarily the heaters. Heaters have a maximum amount of current that they can withstand without melting open or losing calibration.

In contrast to heaters, current sensors output a voltage proportional to the change in current. After an analog-to-digital conversion of the voltage, a microprocessor squares and integrates the converted digital value to achieve a true measure of motor heating. This approach allows for a linear motor protection curve and provides an accurate degree of protection.

A typical example of a starter utilizing a current sensor may be found in U.S. Pat. No. 4,893,102 issued Jan. 9, 1990 to James A. Bauer entitled "Electromagnetic Contactor with Energy Balanced Closing System" and assigned to the assignee of the present invention, which is herein incorporated by reference.

Current sensors and related circuitry are immune to damage by high currents and so are not the limiting factors in establishing short circuit withstand ratings. The current sensor simply saturates under high current conditions, limits the voltage signal transmitted to the analog-to-digital converter and, in turn, the microprocessor. Whenever overload protection is built in, the starter may be the same size as the contactor and, therefore, be much smaller than conventional starters. Smaller physical size combined with reduced heat offers the possibility of: (1) reducing enclosure size and associated cost; (2) more densely populating enclosures, further reducing enclosure cost; and (3) retrofitting existing motor control.

A Class II ground-fault protective starter may sense and respond to low-level and arcing ground-faults often occurring in motor branch circuits. Such a starter opens the circuit with the ground fault, provided the magnitude of the fault current is within the interrupting capability of the device. A branch circuit short circuit protective device clears faults that exceed the interrupting rating of the starter. Such additional catastrophic short circuit withstand protection is generally provided by a separate circuit breaker that is connected in series with the phases of the power line and the contactor. Thus, the circuit breaker is generally the limiting factor in determining the worst case short circuit current that would damage or degrade the contactor and other components of the power circuit.

B. CIRCUIT BREAKERS

Molded case circuit breakers are generally old and well-known in the art. Examples of such circuit breakers are disclosed in U.S. Pat. Nos. 4,489,295; 4,638,277; 4,656,444 and 4,679,018. Such circuit breakers are used to protect electrical circuitry from damage due to an overcurrent condition, such as an overload and relatively high level short circuit condition. An overload condition is normally about 125–600 percent of the nominal current rating of the circuit breaker. A high level short circuit condition can be 1000 percent or more of the nominal current rating of the circuit breaker.

Molded case circuit breakers include at least one pair of separable contacts which may be operated either manually by way of a handle disposed on the outside of the case or automatically in response to an overcurrent condition. A moving contact assembly provides continuity between line and load terminals when the circuit breaker is on. When the circuit breaker trips or is switched off, the moving contact assembly moves away from a stationary contact or contacts.

Trip mechanisms generally provide automatic (thermal and magnetic) and manual (pushbutton) modes to trip the circuit breaker. The thermal and magnetic elements of circuit breakers can be adjusted, for example, by rotating adjustment buttons in the cover of the circuit breaker to a desired setting.

The thermal trip mechanism operates in response to overload conditions. A bimetal element is part of the current carrying path. When there is an overload, the increased current flow heats the bimetal and causes it to bend. As the bimetal bends, it touches and rotates a trip bar causing the circuit breaker to trip. The time needed for the bimetal to bend and trip the circuit breaker varies inversely with the current.

The magnetic trip mechanism operates when there is a high current (short circuit) in the current path. The mechanism includes an electromagnet and an armature. When high level current passes through the conductor, the magnetic field strength of the electromagnet rapidly increases and attracts the armature. As the top of the armature is drawn to the electromagnet, the armature rotates the trip bar causing the circuit breaker to trip.

The pushbutton mechanism provides a manual mode of tripping the circuit breaker by depressing a button located in the circuit breaker cover. When the pushbutton is pressed, a plunger rotates the trip bar causing the circuit breaker to trip.

In the automatic mode of operation, the contacts may be opened by an operating mechanism, controlled by an electronic trip unit, or by magnetic repulsion forces generated between the stationary and movable contacts during relatively high levels of overcurrent.

In one automatic mode of operation, the contact assemblies for all poles are tripped together by an electronic trip unit and a mechanical operating mechanism. More particularly, the electronic trip unit is provided with current sensors to sense an overcurrent condition. When an overcurrent condition is sensed, the current transformers provide a signal to the electronic circuitry within the electronic trip unit to actuate the operating mechanism to cause the main contacts to be separated.

In another automatic mode of operation, the contact arm assemblies are disengaged from the mechanical operating mechanism and are blown open by magnetic repulsion forces. More particularly, magnetic repulsion members or shunts are used to allow the contact arm, which carries the movable main contact, to pivot. Each magnetic repulsion member is generally U-shaped defining two legs. During relatively high level overcurrent conditions, magnetic repulsion forces are generated between the legs of the magnetic repulsion member as a result of current flowing through the legs in opposite directions. At a relatively high level overcurrent condition, these magnetic repulsion forces cause the contact arm carrying the movable main contact to be blown open.

During a blow open condition, each contact arm is operated independently of the mechanical operating mechanism. For example, for a three phase circuit breaker having a high level overcurrent on the A phase, only the A phase contact arm will be blown open by its respective repulsion member. The contact arms for the B and C phases would remain closed and, thus, would be unaffected by the operation of the A phase. The contact arms for the B and C phases are, however, tripped by the electronic trip unit and the operating mechanism. This is done to prevent a condition known as single phasing, which can occur for circuit breakers connected to rotational loads, such as motors. In such a situation, unless all phases are tripped, the motor may act as a generator and contribute to the overcurrent condition. An example of a circuit breaker providing blow open operation may be found in copending U.S. patent application Ser. No. 07/779,441 filed Oct. 13, 1991 by Ronald W. Crookston et al. entitled "Molded Case Current Limiting Circuit Breaker" and assigned to the assignee of the present invention.

A circuit breaker also includes a cradle having latch and reset surfaces for latching and resetting the operating mechanism. A molded case circuit breaker further includes a molded base and a coextensive cover. A centrally located aperture is provided in the cover for receiving an operating handle to allow the circuit breaker to be operated manually. The handle is comprised of an arcuate shaped base portion with a radially extending handle portion.

A common type of circuit breaker has a handle which moves linearly between an on and an off position. The handle is connected to the movable contacts of the circuit breaker through a spring powered, over center toggle device which trips the contacts open and moves the handle to an intermediate position in response to certain overcurrent conditions. This type of circuit breaker may be found in U.S. Pat. No. 4,725,800 to Kurt A. Grunert et al. entitled "Circuit Breaker with Magnetic Shunt Hold Back Circuit" and assigned to the assignee of the present invention, which is herein incorporated by reference.

Another type of circuit breaker has a rotary handle which may be found in U.S. Pat. No. 5,219,070 to Kurt A. Grunert et al. entitled "Lockable Rotary Handle Operator for Circuit Breaker" and assigned to the assignee of the present invention, which is herein incorporated by reference.

In some installations, circuit breakers are mounted behind a panel or behind a door in a cabinet. Typically in these installations, the handles of the circuit breakers protrude through openings in the panel or door and are operated directly. In other installations, the rotary handle is remotely located from the circuit breaker by a shaft connecting the rotary handle to the circuit breaker.

C. POWER CIRCUIT FAULT CURRENTS

In conventional installations, a circuit breaker is connected to one or more contactors or starters to clear faults in the power circuit wiring between the circuit breaker, the starters and the motor. However, the use of multiple starters with an individual circuit breaker increases the normal current carrying capacity requirement of the circuit breaker. Furthermore, the magnitude of the potential fault current and the probability of circuit faults are increased with the increased current carrying capacity required by the circuit breaker. Hence, the increased capacity, increased wiring requirements and larger physical layout of the power circuit increase the likelihood of a catastrophic circuit fault. Moreover, improvements in modern power distribution systems have enabled power sources to supply greater magnitudes of potential fault current.

In prior art systems, under fault conditions involving a line-to-line or line-to-ground fault, excessive current may flow from the alternating current power source. Such excessive current could flow through the circuit breaker, the power circuit wiring, the contactor and the motor. Because of the trip characteristics of the contactor, which is merely designed for interrupting currents associated with a motor load or overload, the circuit breaker acts first to protect the circuit. However, high level short circuit faults may, nevertheless, cause damage, reduced component life or excessive visual display.

There remains a need therefore for an improved circuit controller that will reduce the potential for fault current damage in the case of a severe electrical disruption.

There is a more particular need for an improved circuit controller that combines a circuit breaker, a current throttle and a contactor having an overload relay, the combination acting in unison during a potentially massive fault current, so that each device complements the other devices and also has the capability of being reentered into usable service, with no rehabilitation.

There is a further need for an improved circuit controller that will limit the potential fault current from a modern power distribution system without increasing the complexity and the cost of the circuit breaker.

There is a more particular need for an improved circuit controller that is housed in an integral, compact modular unit for the coordination of fault damage control without providing additional circuit wiring.

There is still a further need for an improved circuit controller having a current throttle impedance that allows normal rated load current to flow indefinitely with no deleterious effect but, also, substantially limits current flow in case of a high potential fault current such as a 100 KA, three phase bolted fault current without current throttle limitation.

There is more particular need for an improved circuit controller having a current throttle that minimizes resistive power losses and heat generation.

There is also a need for an improved circuit controller that provides a user-configurable current throttle, for limiting fault current, that provides an additional impedance beyond that of the circuit wiring.

There is still a further need for an improved circuit controller having a current throttle that has a built in thermal transfer capability for heat that is generated.

There is yet another need for an improved circuit controller having a current throttle that is housed in a protective, concealed and secure enclosure to maintain a stable coil-form in the enclosure and to enhance user safety and security, for operators and examining personnel, from exposed electrical conductors and heated components.

SUMMARY OF THE INVENTION

These and other needs are satisfied by the invention which is directed to an integral electrical circuit controller having a contactor, a circuit breaker and a current throttle for limiting fault current flowing through the controller and the associated power circuit. In accordance with the invention, the circuit breaker, current throttle and contactor are connected in series between the phases of an alternating current power source and a load, such as a motor. Alternatively, the contactor may have an overload relay for operation as a starter or motor controller.

Independently, the contactor or starter and circuit breaker may provide circuit connection and disconnection functions that are well-known in the art. For example, the starter may open the circuit after sensing excessive motor current that may cause the motor to overheat. Also, the starter may close the circuit in response to a manual start motor request initiated by a pushbutton associated with the contactor.

Similarly, the circuit breaker may open the power circuit automatically in response to excessive short circuit fault currents flowing in the power circuit. Also, the circuit breaker may open the power circuit in response to manual operation of the circuit breaker via a linearly or rotatably movable handle.

Under normal conditions, the current throttle provides minimal resistive power losses ($I^2R$) and heat generation whenever normal rated motor current flows from the power source to the motor. For example, in the exemplary embodiment, having 7A rated continuous current in the power circuit, less than 2 W of power per phase is dissipated by the current throttle. This results in a temperature rise, above ambient temperature, of about 4° C. at the current throttle.

The power source used in the exemplary embodiment has three phases and is capable of providing 100KA at 480 VAC. In a bolted three phase line-ground fault, the current throttle limits the peak short circuit current. This peak current is substantially less than the short circuit current of conventional systems. Such systems use conventional external wiring between the circuit breaker and the contactor or starter. Furthermore, conventional systems are susceptible to trip sensing coil damage, significant component degradation or excessive visual display.

The integral circuit controller minimizes the required power circuit wiring and also provides an additional effective impedance between the circuit breaker and the contactor to limit the common fault current flowing through both devices. In particular, for each phase of the power circuit, wiring is required between the power circuit line and the circuit breaker portion of the integral circuit controller. Also, wiring is required between the contactor or starter portion of the integral circuit controller and the load or motor. However, external wiring between the circuit breaker and the contactor is eliminated.

In addition, an integral current throttle is provided between the circuit breaker and the contactor to limit fault current. The current throttle provides an additional impedance (inductive and resistive) to limit the fault current while also minimizing the resistive power losses and heat generation within the current throttle.

In an alternative embodiment of the invention, suitable for relatively high continuous current capacity applications, the current throttle further dissipates heat from the integral circuit controller by the addition of an external heat sink. The external heat sink is provided to further reduce the temperature rise, above ambient temperature, of the controller caused by the resistive portion of the current throttle and its associated $I^2R$ power losses.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

A. CIRCUIT BREAKER

Figure 1:
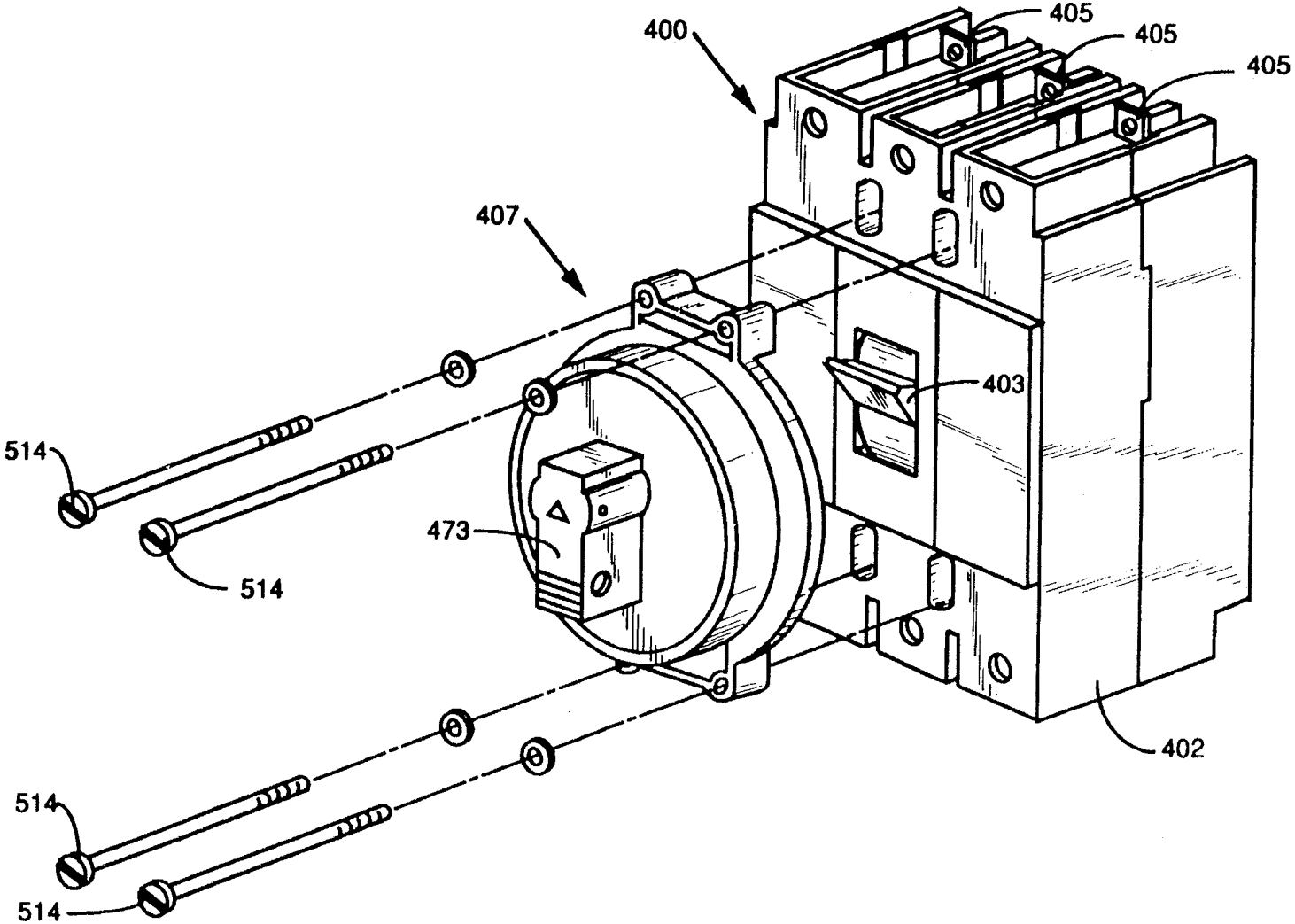
FIG. 1 PRIOR ART
FIG. 1 is an isometric view of a circuit breaker.
Figure 1A:
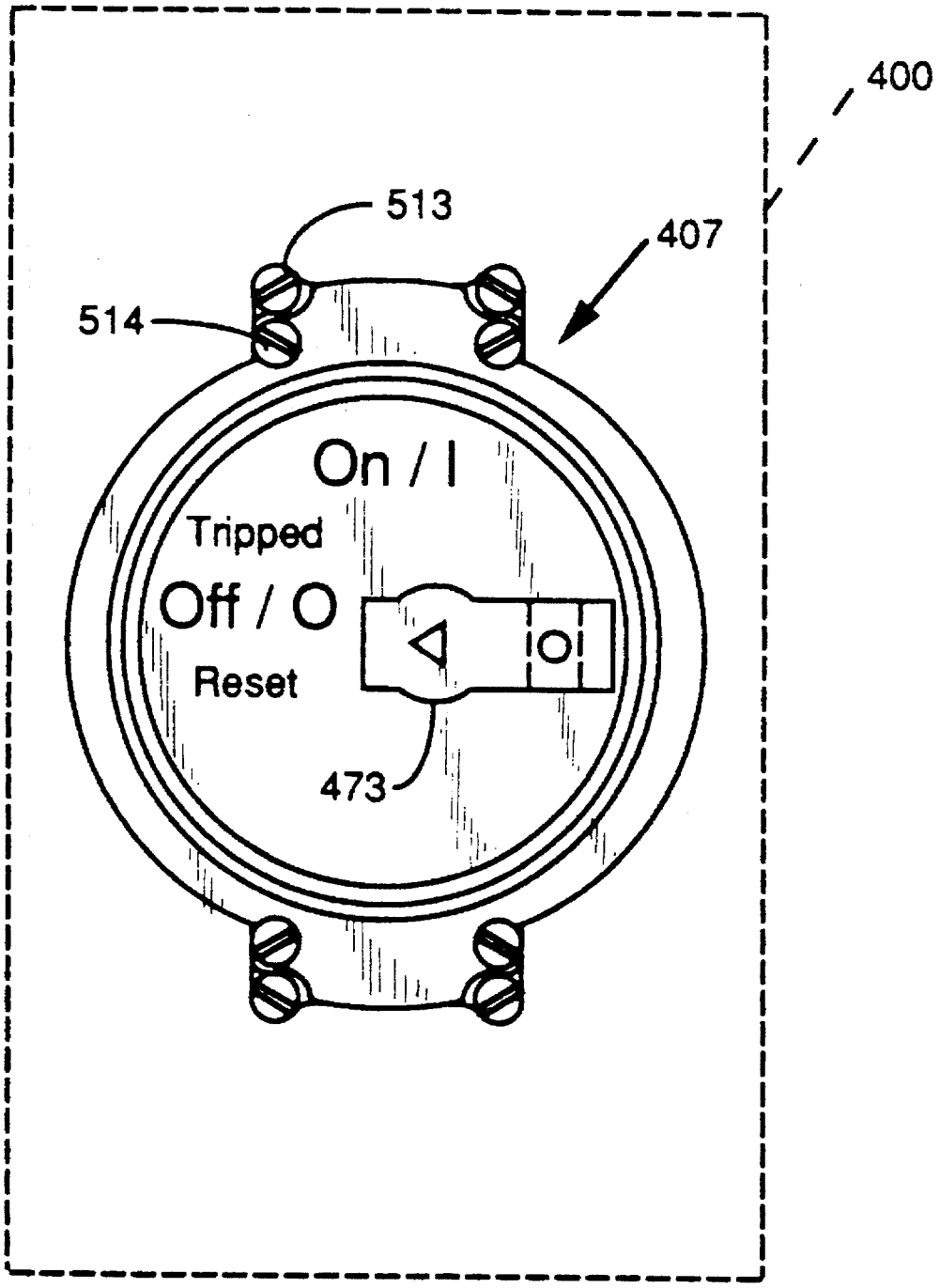
FIG. 1a PRIOR ART
FIG. 1*a* is a front view of a rotary handle operator.
Figure 1B:
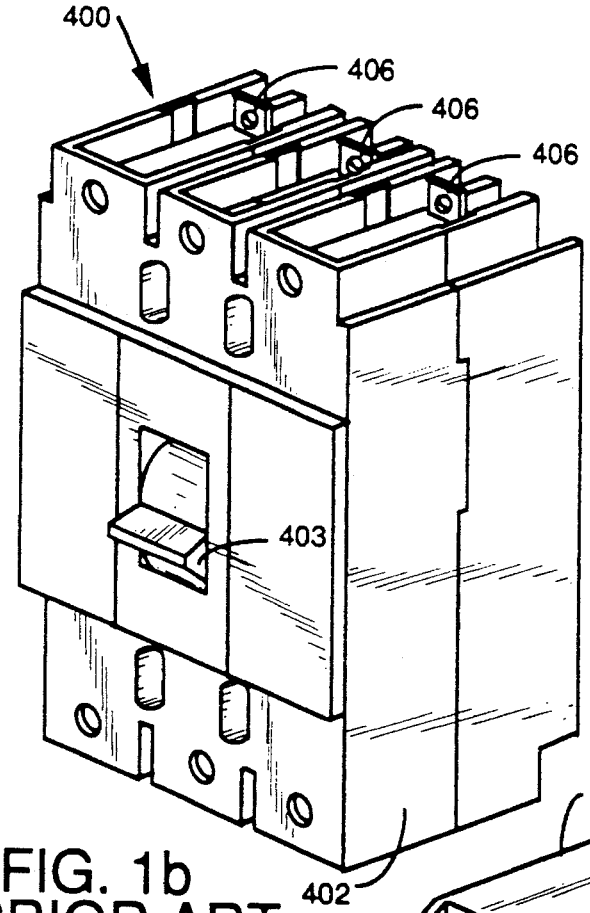
FIG. 1b PRIOR ART
FIG. 1*b* is an isometric view of the circuit breaker of FIG. 1 rotated to show lower load terminals.

Referring to FIGS. 1–1*b*, a rotary handle operator 407 is applied to a molded case circuit breaker 400 having a molded enclosure 402 and handle 403. The enclosure 402 is made of a suitable electrical insulating material such as a glass/nylon composition. While the exemplary circuit breaker 400 is a three phase breaker, the invention is applicable to any breaker having any number of phases. With the handle 403 in the raised position, as shown, the well-known internal mechanism of the breaker closes separable electrical contacts 410 (see FIG. 7) to complete a circuit between three phase line terminals 405 on top of the exemplary breaker and load terminals 406 similarly located at the bottom of the breaker.

When the handle 403 is moved down to an off position, the electrical contacts are opened to interrupt the circuit between the line and load terminals 405,406. Under certain current overload conditions, the circuit breaker 400 trips to open the contacts, and the handle 403 is positioned to an intermediate trip position just above the off position. To reset the tripped breaker, the handle 403 is pressed downward slightly below the off position. The handle can then be returned to the on position to reclose the contacts.

In conventional installations, the circuit breaker 400 is mounted to a panel 560 (e.g., see FIG. 8*b*) which in many instances is behind a door in a cabinet. Often it is desirable to have an interface through which the circuit breaker 400 can be operated for additional electrical isolation and/or providing a moisture proof seal for the breaker which is typically not sealed tightly around the handle 403. It is also desirable in some installations to have a rotary operating handle rather than a linearly movable handle for the interface.

Figure 7:
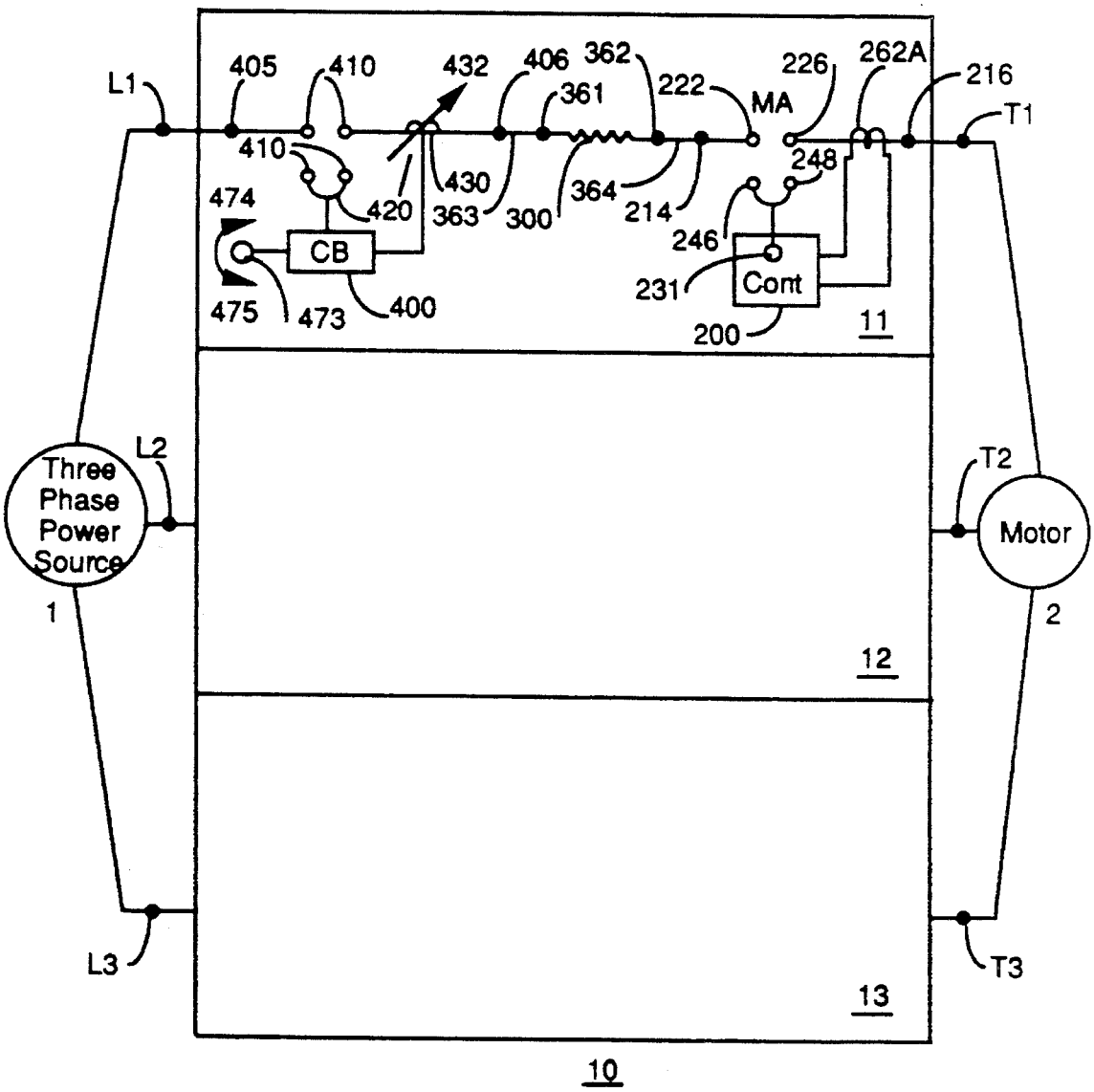
FIG. 7 shows a circuit diagram and wiring schematic partially in block diagram form for the integral electrical circuit controller.
Figure 8:
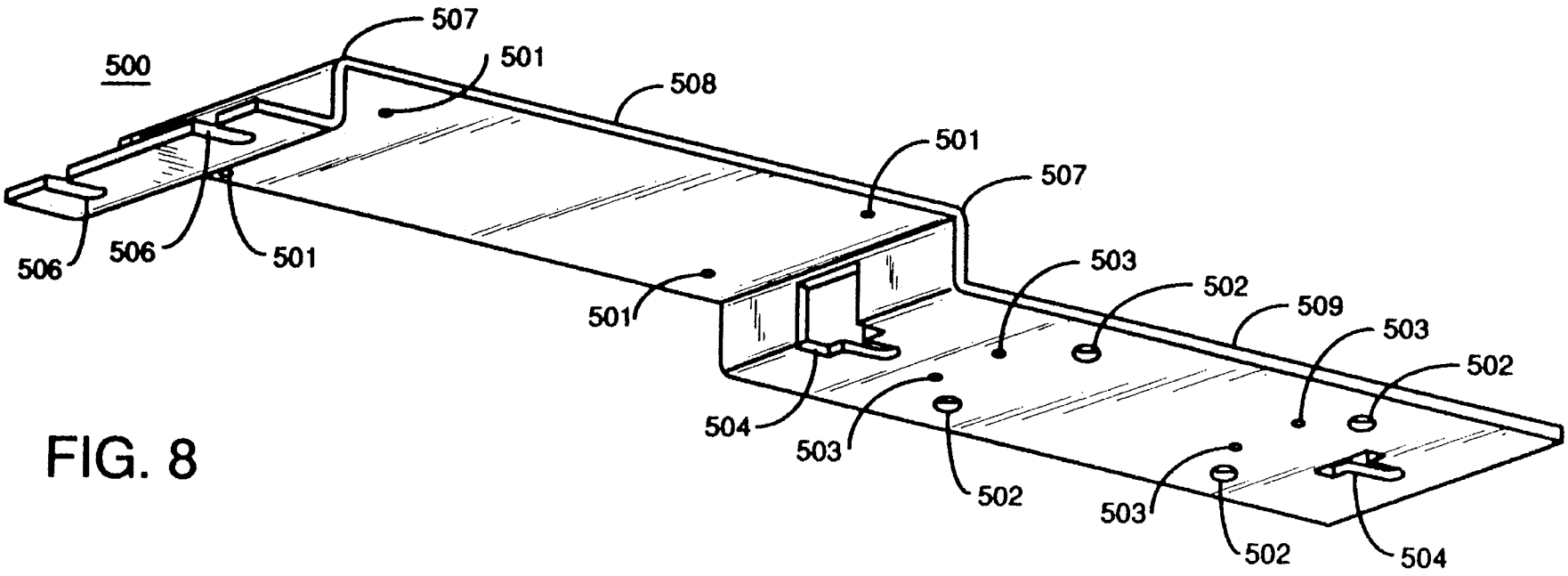
FIG. 8 is an isometric view of a base plate for the integral electrical circuit controller.
Figure 8A:
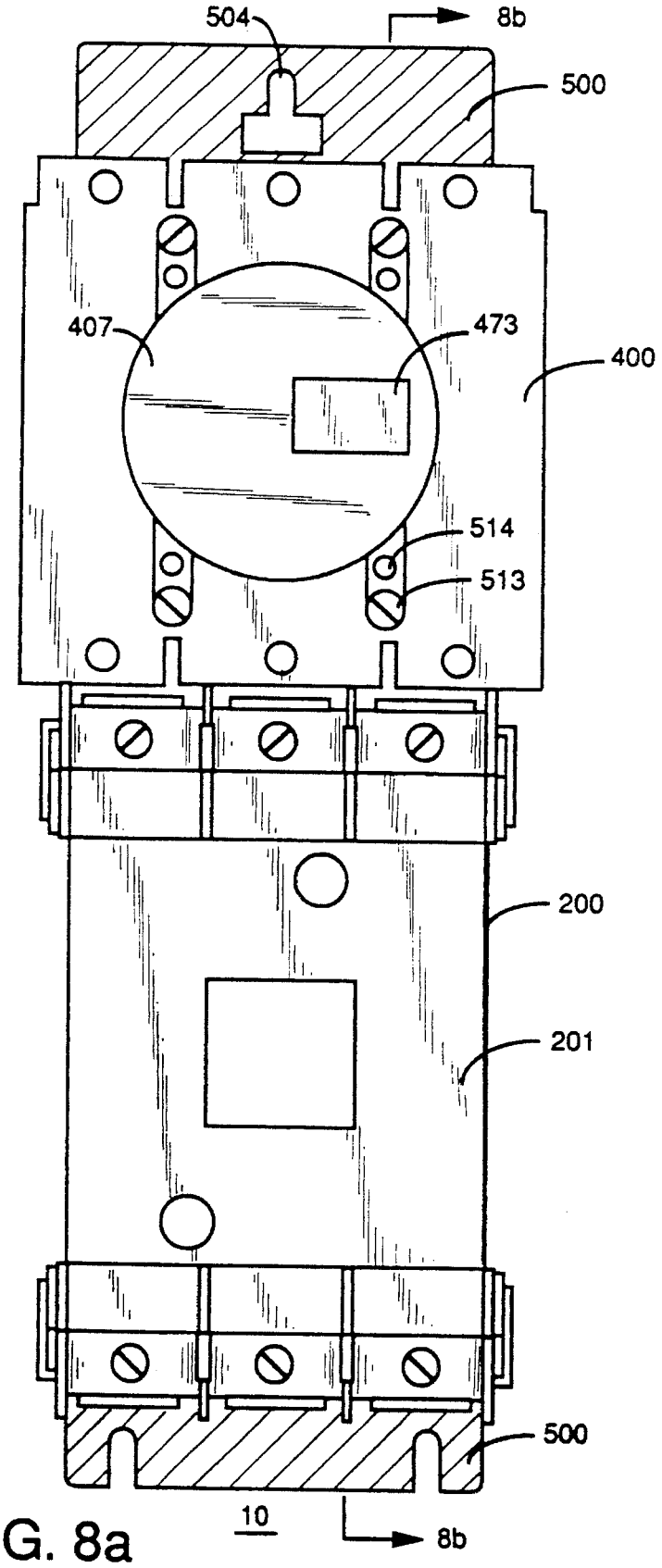
FIG. 8*a* is a front view of the integral electrical circuit controller.
Figure 8B:
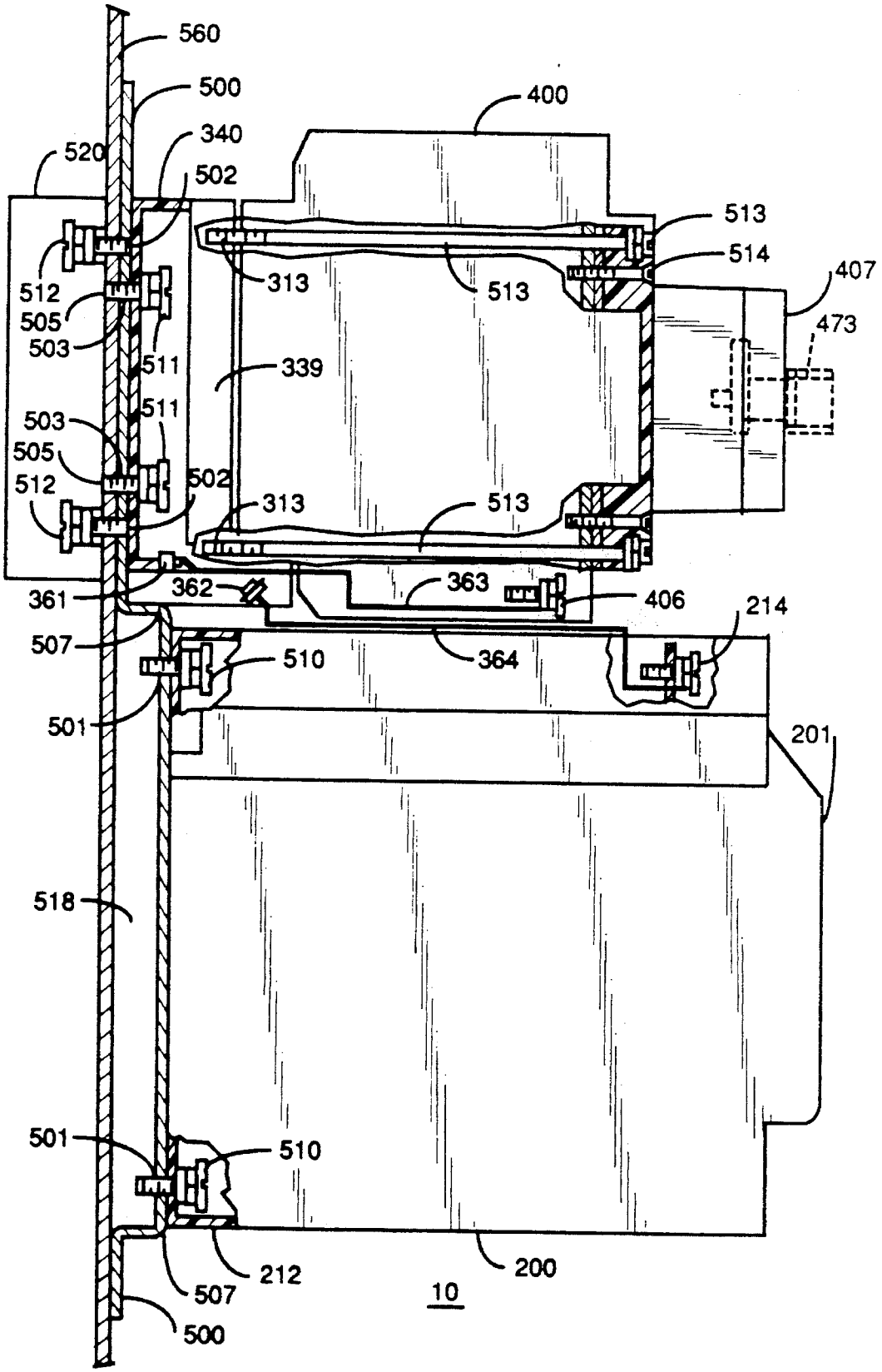
FIG. 8*b* shows a cutaway elevation of the integral electrical circuit controller along Line 8*b*—8*b* of FIG. 8*a*.

In operation, in the exemplary embodiment, the rotary handle operator 407 is mounted on the front of circuit breaker 400 either before or concurrently with the mounting of the breaker on a current throttle 300 (see FIG. 8*b*). Referring to FIGS. 1 and 1*a*, with the circuit breaker handle 403 in the on position, the rotating handle 473 is vertical. If it is desired to turn the circuit breaker off, the handle 473 is rotated counter-clockwise. As the rotating handle 473 reaches the horizontal position, the handle 403 of the circuit breaker is moved down sufficiently to toggle the circuit breaker separable contacts 410 (see FIG. 7) open.

If the circuit breaker trips, the internal mechanism of the breaker will move the circuit breaker handle 403 from the on position to the intermediate, tripped position. As the circuit breaker handle 403 is engaged, the rotary handle 473 will also be moved to the trip position. The circuit breaker is then reset by rotating the rotating handle 473 further counter-clockwise slightly past the off position to the reset position, which moves the circuit breaker handle 403 all the way down to the reset position below the off position.

In the exemplary embodiment, the circuit breaker 400 is a three phase Westinghouse GMCP Motor Circuit Protector having a catalog number of GMCP007C0 and capable of interrupting 7A of rated continuous current at 480 VAC. However, the invention is applicable to any circuit breaker.

B. CONTACTOR

Figure 2:
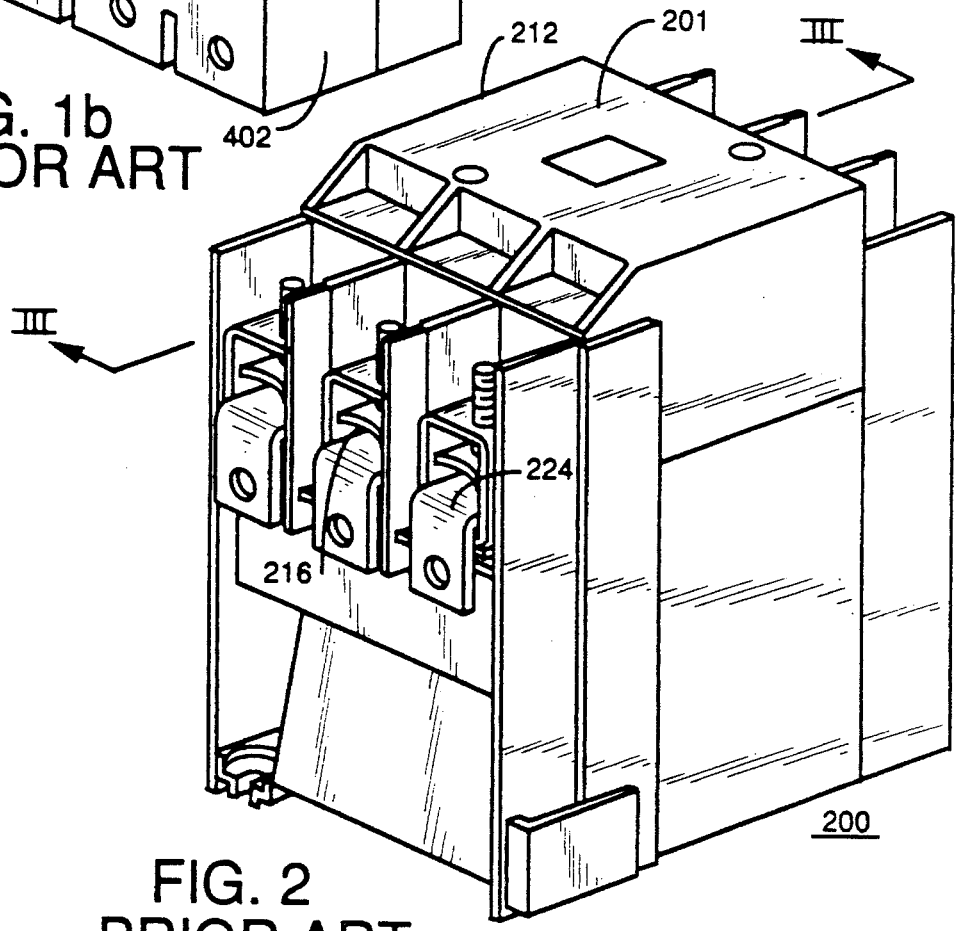
FIG. 2 PRIOR ART
FIG. 2 is an isometric view of an electromagnetic contactor having an integral current sensor.
Figure 3:
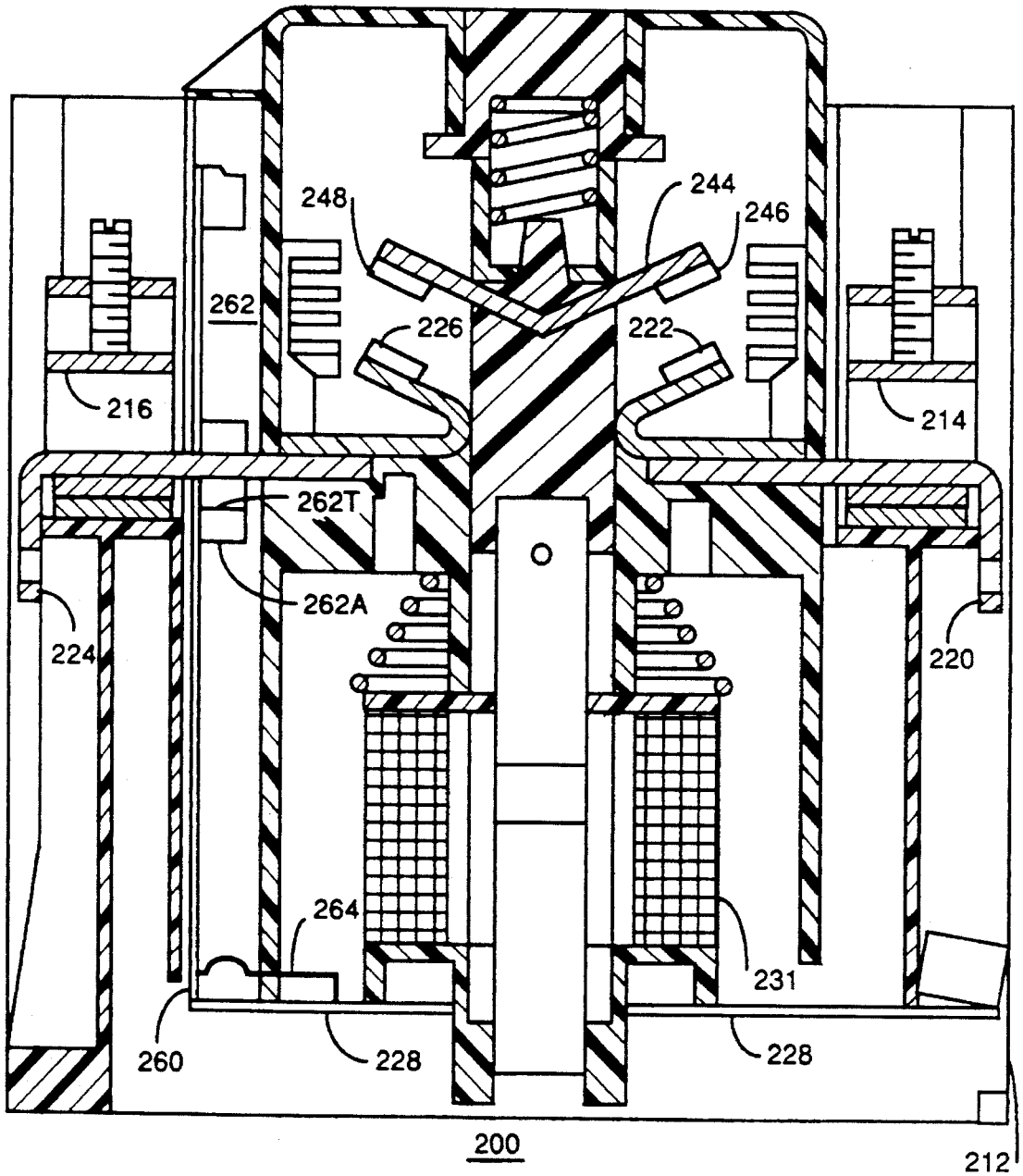
FIG. 3 PRIOR ART
FIG. 3 shows a cutaway elevation of the contractor of FIG. 2 at Section III–III thereof.

Referring to FIGS. 2 and 3, a three phase electrical contactor 200 is shown. For the purpose of simplicity of illustration, the construction features of only one of the three phases will be described, it being understood that the other two phases are the same. While the exemplary contactor is a three phase contactor having an overload relay 260, the invention is applicable to any contactor or starter having any number of phases.

Contactor 200 comprises a molded housing 212 made of suitable electrical insulating material such as a glass/nylon composition upon which are disposed electrical line and load terminals 214 and 216 for interconnection with a load to be serviced or controlled by the contactor 200. Such a system is shown schematically in FIG. 4, for example. Continuing to refer to FIGS. 2 and 3, terminals 214 and 216 are spaced apart and interconnected internally with conductors 220 and 224, respectively, which extend into the central region of the housing 212. Therein, conductors 220 and 224 are terminated by appropriate fixed contacts 222 and 226, respectively. Interconnection of contacts 222 and 226 will establish circuit continuity between terminals 214 and 216 and render the contactor 200 effective for conducting electrical current therethrough. A separately manufactured coil control board 228 may be securely disposed within housing 212. Disposed on the coil control board 228 is an electrical coil 231.

On one radial arm of an electrically conducting contact bridge 244 is disposed a contact 246, and on another radial arm of contact bridge 244 is disposed a contact 248. Of course, it is to be remembered that the contacts are in triplicate for a three phase contactor. Contact 246 abuts contact 222 (222–246), and contact 248 abuts contact 226 (226–248) when a circuit is internally completed between the terminal 214 and terminal 216 as the contactor 200 closes. On the other hand, when the contact 222 is spaced apart from contact 246 and the contact 226 is spaced apart from contact 248, the internal circuit between the terminals 214, 216 is open. The open circuit position is shown in FIG. 3.

There may also be provided within the housing 212 of the contactor 200 an overload relay printed circuit board 260 upon which are disposed current-to-voltage transducers 262 (only one of which 262A is shown in FIG. 3). Overload relay board 260 is connected with coil control board 228 via flat cable 264.

The conductor 224 may extend through the toroidal opening 262T of the current-to-voltage transducer 262A so that current flowing in the conductor 224 is sensed by the current-to-voltage transducer 262A. The information thus sensed is utilized advantageously in a manner described in detail in U.S. Pat. No. 4,893,102, referenced hereinbefore, for providing useful circuit information for the contactor 200, so that the overload relay board 260, coil control board 228 and electrical coil 231 may operate the contacts 246,248 to open and close the contactor.

As is well-known in the art, the overload relay board 260 may further include an overload trip adjustment (not shown) that is user-accessible via front surface 201 for factory calibration, time delay adjustment and designating the heater class of the load protected by the overload relay board 260.

Figure 4:
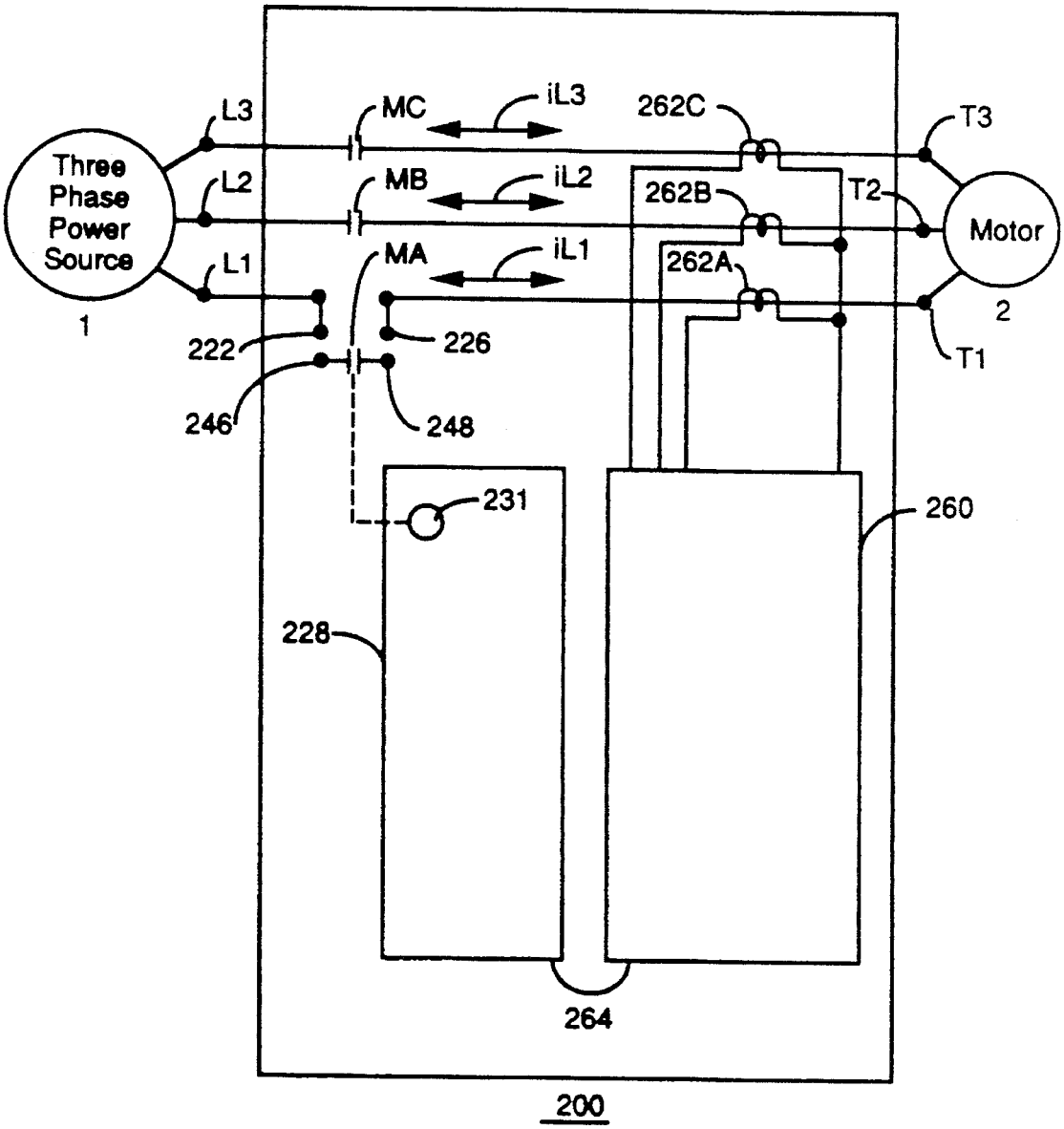
FIG. 4 PRIOR ART
FIG. 4 shows a circuit diagram and wiring schematic partially in block diagram form for the contactor of FIG. 3 as utilized in conjunction with a motor.

Referring now to FIG. 4, which omits circuit breaker 400 and current throttle 300 for the purpose of simplicity of introduction, there are provided three main power lines L1, L2, L3 which provide three phase alternating current (AC) electrical power from a suitable three phase power source 1. These lines are fed through contactors MA, MB, MC, respectively.

In addition, the secondary windings of the current transducers 262A through 262C are shown interconnected with the overload relay board 260. The transducers 262A through 262C monitor the instantaneous line currents iL1, iL2, iL3 in lines L1, L2, L3, respectively, which are drawn by motor 2 interconnected with the lines L1, L2, L3 by way of terminals T1, T2, T3, respectively. Contactors MA, MB, MC are operated by electrical coil 231 of coil control board 228 to complete the circuit between the power lines L1, L2, L3 and the motor terminals T1, T2, T3.

In the exemplary embodiment, the contactor 200 is a three phase, 27A, 10 HP, 460/575 VAC Westinghouse Advantage Starter having a catalog number of W200M1CFC and a NEMA starter size of 1. However, the invention is applicable to any contactor or starter.

C. CURRENT THROTTLE

Figure 5:
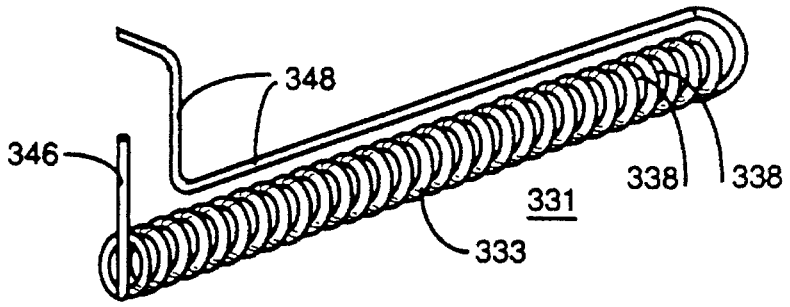
FIG. 5 is an isometric view of a coiled cylindrical conductor.
Figure 5A:
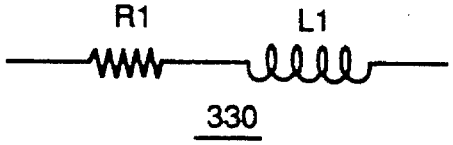
FIG. 5*a* is an equivalent schematic diagram of the coiled cylindrical conductor.
Figure 6:
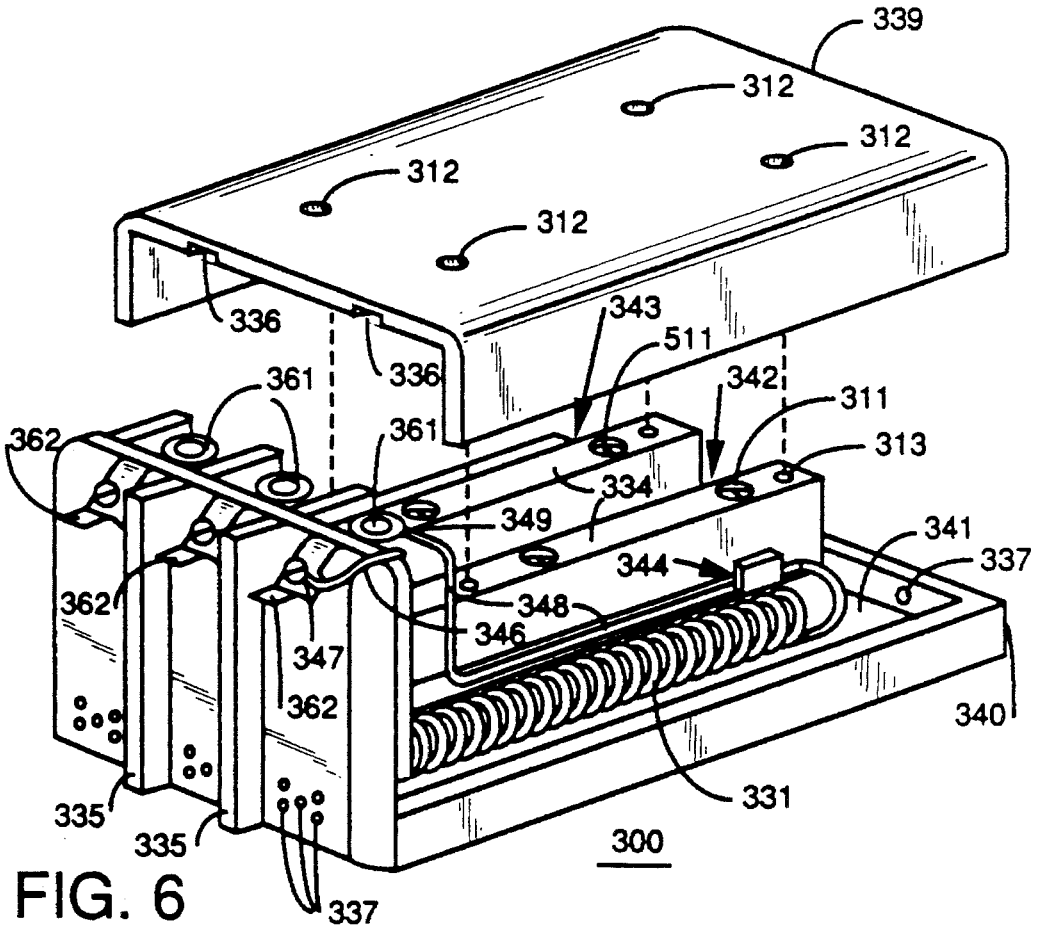
FIG. 6 is an isometric view of a current throttle has a dielectric housing.

Referring now to FIGS. 5, 5*a* and 6, current throttle impedance element 330 is illustrated by coiled cylindrical conductor 331. In the exemplary embodiment, impedance element 330 provides an impedance comprising a resistance R1 and an inductance L1. Impedance element 330 is formed by coiling, about 27 times, a round nichrome wire 333, having a diameter of about 0.062 inches, a length of about 38 inches and a coil-form length of approximately 5 inches, to form the coiled cylindrical conductor 331 as shown in FIG. 5. For simplicity of introduction, the coiled cylindrical conductor 331 of FIG. 5 is shown without additional wire lengths and terminals for interconnection with the circuit breaker 400 and the contactor 200.

The coiled cylindrical conductor 331 has a minimum gap spacing 338 between each wire turn that must be maintained for proper turn-to-turn isolation and adequate dielectric spacing. In the exemplary embodiment, the gap spacing dimension is about 0.020 inches and the diameter of the cylindrical coil is about 0.449 inches.

Although the wire 333 used in the exemplary embodiment is round, alternative embodiments may use a square wire (not shown). Furthermore, for alternative embodiments requiring a rated continuous current of greater than about 50A to 150A, the coiled cylindrical conductor 331 may be replaced by a flat conductive strap (not shown).

Those skilled in the art will appreciate that the resistance R1 and inductance L1 of impedance element 330 may be varied by the type of wire chosen, the number of wire turns, the diameter of each turn, the use of a magnetic core (not shown) within the cylindrical conductor, etc. In the exemplary embodiment, coiled cylindrical conductor 331 provides about 0.0354 ohms of resistance and about 0.001H of inductance. Those skilled in the art will also appreciate that additional coil shapes, beyond the exemplary cylindrical shape, are possible, such as a coiled conical conductor (not shown). Furthermore, wire 333 may be chosen from a variety of materials such as the exemplary nichrome, as well as iron or copper, for example, to achieve the appropriate resistance and short circuit current carrying capacity.

In a bolted three phase line-ground fault, and using the exemplary power source providing 100KA at 480 VAC, the exemplary current throttle limits the peak current to about 2.4KA within 25,000 $A^2$-S ($I^2t$). By comparison, a conventional system, having conventional external wiring between a contactor having a solid-state overload relay and a circuit breaker, merely limits the peak current to about 10KA within 50,000 $A^2$-S ($I^2t$). At this conventional level, there would typically be damage to the trip sensing coil of the circuit breaker and the contact structure of the contactor. Similarly, in a conventional system having a starter and a series resistance heater, the peak current is about 4.8–5.0KA within 50,000 $A^2$-S ($I^2t$). Nevertheless, significant component degradation and excessive visual display would result at this level of fault current.

Referring now to FIG. 6, the structure of current throttle 300 is illustrated. A molded dielectric housing 340 and three coiled cylindrical conductors 331 comprise three phase current throttle 300. For the purpose of simplicity of illustration, only one conductor 331 is shown in FIG. 6. The molded housing 340 is made of a suitable electrical insulating material such as a glass/nylon or polyester composition. Although the exemplary current throttle 300 has three phases, the invention is applicable to current throttles having any number of phases.

Continuing to refer to FIG. 6, each individual conductor 331 has additional wire lengths 346,348. The wire lengths 346,348 have ends 347,349, respectively. The two ends 349,347 are attached to terminals 361,362 which are connected to circuit breaker three phase load terminal 406 and contactor electrical line terminal 214, respectively (see FIGS. 7 and 8*b*). In the exemplary embodiment, approximately 2 inches of wire 348 is required for connection to terminal 361 and approximately 2 inches of wire 346 is required for connection to terminal 362. Thus, the total continuous length of nichrome wire 333 in the cylindrical coiled conductor 331 of the exemplary embodiment is about 42 inches (38 inches plus 2 inches plus 2 inches).

Still referring to FIG. 6, housing 340 has three coil channels 341,342,343 associated with power lines L1,L2, L3, respectively, for holding the three coiled conductors 331. Wire 348 is routed in narrow channel 344 and has end 349 terminated at circuit breaker terminal 361. Wire 346 has end 347 terminated at contactor terminal 362. Wires 346,348 of coiled cylindrical conductor 331 may be secured to housing 340 by an insulating clip or strap (not shown).

Coil channels 342 and 343, for the remaining phases of the exemplary current throttle, each have an associated narrow channel 344. The three channels 341,342,343 and the three narrow channels 344 are situated in a like manner and are separated by interphase barriers 334 which provide electrical isolation between the three phases of current throttle 300. Similarly, external interphase barriers 335 provide isolation between the individual phases of terminals 361 and 362. Vent holes 337 are situated at the proximate and distal ends of housing 340 to permit air flow through the current throttle housing 340 to reduce the internal temperature rise, above ambient temperature.

The top of housing 340 is generally open to accept the coiled conductors 331. The housing 340 has a cover 339 made of the same material as the housing. The cover 339 has interphase barrier channels 336 for interphase barriers 334 and encloses the coiled conductors 331 within the housing 340.

Referring to FIGS. 6 and 8*b*, housing 340 includes mounting holes 311 for accepting current throttle conventional mounting hardware 511, including flat head screws, lock washers and washers. Similarly, cover 339 and housing 340 include holes 312 and threaded mounting holes 313, respectively, for accepting circuit breaker mounting hardware 513. During disassembly, after removing power to the circuit breaker line terminals 405, insulated electrical jumper 363 may be disconnected from circuit breaker 400 circuit breaker 400 may be disconnected from housing 340 of current throttle 300; cover 339 may be removed from housing 340; and the current throttle impedance may be user-modified by removing and replacing coiled conductor 331 with a different coiled conductor 331 having a user-selected impedance. Thus, the appropriate impedance element may easily be user-selected and user-modified.

Referring now to FIG. 7, a schematic diagram of the integral electrical circuit controller 10 is illustrated. For the purpose of simplicity of illustration, the electrical features of only one of the three phases (L1) will be described in circuit 11, it being understood that the other two phases (L2,L3) and their associated circuits 12,13 are the same. While the exemplary integral circuit controller 10 is a three phase apparatus, the invention is applicable to any number of phases.

In general, three phase power source 1 provides AC electrical power via power lines L1–L3 to motor 2 by way of terminals T1–T3. Integral electrical circuit controller 10, for each of the three phases, provides a series connection of circuit breaker 400, current throttle 300 and contactor 200. In particular, power line L1 is connected to line terminal 405 of circuit breaker 400. Such connection is well-known by those skilled in the art and may include, for example, pressure type terminals, rear connecting studs, plug-in adapters and other methods of circuit connection that are well-known in the art.

Load terminal 406 of circuit breaker 400 is directly connected via insulated electrical jumper 363 to terminal 361 of current throttle 300. The other terminal 362 of current throttle 300 is directly connected via insulated electrical jumper 364 to electrical line terminal 214 of contactor 200. Electrical load terminal 216 of contactor 200 is connected to terminal T1 of motor 2 by the same method of circuit connection described hereinbefore for line terminal 405.

Still referring to FIG. 7, circuit breaker 400 includes rotating handle 473 for turning the circuit breaker off, by a counter-clockwise rotation 475, and on, by a clockwise rotation 474. As illustrated by FIG. 7, the circuit breaker separable contacts 410 are open and, thus, the circuit breaker 400 is either in an off or a trip position. Finally, as is well-known in the art, circuit breaker 400 further includes a magnetic trip mechanism 420 having a trip sensing coil 430 and a short circuit trip adjustment 432. The magnetic trip mechanism 420 operates, whenever there is a high or short circuit current in the current path of the trip sensing coil 430 between separable contacts 410 and load terminal 406, and causes the circuit breaker to trip with contacts 410 in the open position.

Continuing to refer to FIG. 7, three phase contactor 200 and individual contactor MA include contacts (222–246) and (226–248), illustrated in an open circuit position, and current transducer 262A. The transducer 262A senses the current flowing in the conductor between contact 226 and electrical load terminal 216 which is connected to terminal T1 of motor 2. As is well-known in the art, the contactor 200 includes a current sensor (not shown) for monitoring the line current drawn by motor 2 and utilizes electrical coil 231 to open and close the contacts (222–246) and (226–248) to control and also protect motor 2.

Referring now to FIGS. 8–8*b*, the mechanical packaging of integral electrical circuit controller 10 having a back plate 500 is illustrated. Although the exemplary integral circuit controller 10 integrates the back plate 500 with separable housings 212,340,402 for the contactor 200, current throttle 300 and circuit breaker 400, respectively, the invention may also be applied to integral circuit controllers having fewer housings (e.g., one common housing) (not shown).

In particular, FIGS. 8 and 8b illustrate back plate 500 which is suitable for mounting on a conventional panel 560. In the exemplary embodiment, back plate 500 is made of steel and has two bends 507 to form an elevated flat area 508 for mounting contactor 200. Similarly, flat area 509 is for mounting current throttle 300.

The back plate 500 further has two upper mounting slots 504 and two lower mounting slots 506 which mate with conventional mounting hardware (not shown) provided on panel 560. Four threaded mounting holes 501 accept conventional mounting hardware screws 510 for securing contactor 200 to the front of back plate 500 at flat area 508. Similarly, four threaded mounting holes 503 accept conventional mounting hardware screws 511 for securing current throttle 300 to back plate 500 at flat area 509. Finally, as further illustrated in FIGS. 8*c*–8*d*, four clearance holes 502 allow conventional mounting hardware screws 512 to secure an optional heat sink 520 to the rear of panel 560.

Figure 8C:
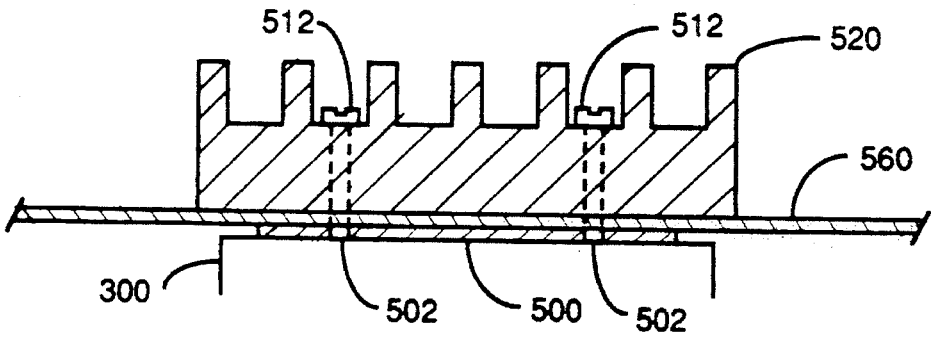
FIG. 8*c* is a top view of a heat sink mounted to a panel along Line 8*c*—8*c* of FIG. 8*b*.
Figure 8D:
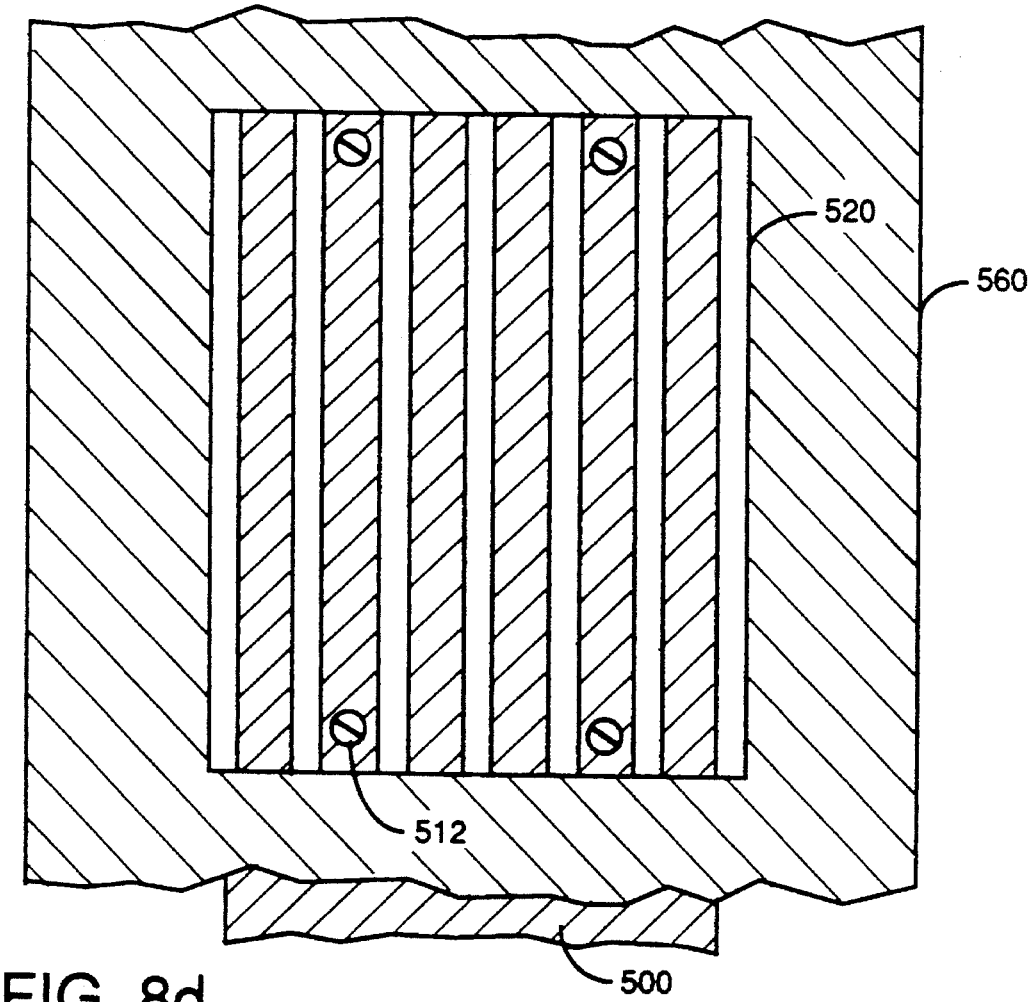
FIG. 8*d* is a rear view of the heat sink mounted to the panel.

Referring now to FIGS. 8*a*–8*d*, the general mechanical interconnection of integral electrical circuit controller 10 is illustrated. The front of conventional panel 560 accepts back plate 500 and the rear of panel 560 accepts optional heat sink 520. The exemplary heat sink 520 is finned aluminum, but any heat sink such as a flat plate or a rectangular tube may be utilized. As shown in FIGS. 8*c*–8*d*, optional heat sink 520 may be attached to four threaded mounting holes (not shown) in panel 560 by conventional mounting hardware screws 512. As shown in FIG. 8*c*, clearance holes 502 allow the threads of mounting hardware 512 to partially enter back plate 500 without interfering with current throttle 300.

Optional heat sink 520 is discussed to fully illustrate the features of back plate 500. The heat sink 520 is not required in the exemplary embodiment, but may be attached in an alternative embodiment requiring no more than a minimal temperature rise caused by the thermal power losses in current throttle 300. Those skilled in the art will appreciate that a thermal compound (not shown) may be required to optimize the heat transfer between the current throttle 300, back plate 500, panel 560 and heat sink 520. Thus, excess heat is dissipated to the rear of the panel.

Referring now to FIGS. 8 and 8b, conventional mounting hardware 510 is used to secure contactor 200 to flat area 508 of back plate 500 via four threaded holes 501 in the back plate. As shown in FIG. 8*b*, contactor 200 is spaced away from panel 560 so that the front 201 of contactor 200 and the rotary handle 473 of circuit breaker 400 are approximately equally spaced from the panel. Moreover, any heat transferred from current throttle 300 via panel 560 to contactor 200 is minimized by air gap 518.

Similarly, conventional mounting hardware 511 and mounting holes 311 of current throttle 300 are used to secure current throttle 300 to flat area 509 of back plate 500 via four threaded holes 503. As shown in FIG. 8*b*, panel 560 includes clearance holes 505 for mounting hardware 511 so that back plate 500 is flush with panel 560.

In an alternative embodiment, where optional heat sink 520 is used, mounting hardware 511 is selected to not protrude through panel 560 or, else, additional clearance holes (not shown) are provided in heat sink 520.

As previously discussed, before circuit breaker 400 is attached to current throttle 300, or in the event circuit breaker 400 is detached from current throttle 300, coiled conductor 331 may be user-modified to alter the impedance between circuit breaker 400 and contactor 200. Furthermore, in alternative embodiments where coiled conductor 331 provides a relatively high power dissipation, optional heat sink 520 may be added as previously discussed.

Subsequently, after current throttle 300 has been attached or modified, conventional mounting hardware 513 is used to secure circuit breaker 400 to current throttle 300. As shown in FIG. 8*b*, and as apparent to those skilled in the art, hardware 513 is identical to the conventional hardware utilized to secure a circuit breaker to a threaded panel. In the exemplary embodiment, four threaded mounting holes 313 in current throttle 300 secure the threads of mounting hardware 513 to attach circuit breaker 400 to current throttle 300.

Finally, conventional terminals 361,362 of housing 340 are connected via insulated electrical jumpers 363,364, respectively, to the appropriate phase of circuit breaker 400 and contactor 200. In particular, for L1, circuit breaker terminal 361 of housing 340 terminates to L1 load terminal 406 of circuit breaker 400. Similarly, for L1, contactor terminal 362 of housing 340 terminates to L1 electrical line terminal 214 of contactor 200. The other coiled conductors for any number of additional phases (such as L2 and L3) are connected in a like manner to the respective terminals of the contactor and the circuit breaker.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed:

1. An integral electrical circuit controller apparatus selectively connecting a load to a power source, said apparatus comprising:

an electrical contactor having contacts;

a circuit breaker having separable contact means connected in series with said contacts of said electrical contactor, said circuit breaker further having trip means responsive to current flowing through said separable contact means for tripping said separable contact means open in response to predetermined current conditions, so that said trip means and said electrical contactor independently interrupt current flowing through said electrical contactor and said circuit breaker; and current throttle impedance means connected in series with said contacts of said electrical contactor and said separable contact means of said circuit breaker for limiting short circuit current flowing through said electrical contactor and said circuit breaker until current is interrupted.

2. The integral electrical circuit controller apparatus as recited in claim 1, wherein said current throttle impedance means has a resistive and an inductive impedance.

3. The integral electrical circuit controller apparatus as recited in claim 1, wherein said current throttle impedance means has a substantially resistive impedance.

4. The integral electrical circuit controller apparatus as recited in claim 1, wherein said current throttle impedance means comprises a coiled conductor having a resistive and an inductive impedance and a dielectric housing enclosing said coiled conductor.

5. The integral electrical circuit controller apparatus as recited in claim 1, said apparatus further comprising a base plate and means for holding said electrical contactor, said current throttle impedance means and said circuit breaker.

6. The integral electrical circuit controller apparatus as recited in claim 5, wherein said base plate further has heat transfer means for dissipating heat from said current throttle impedance means.

7. The integral electrical circuit controller apparatus as recited in claim 1, wherein said electrical contactor further has an overload relay and means for controlling a motor, and wherein said current throttle impedance means further limits short circuit current flowing through said motor.

8. The integral electrical circuit controller apparatus as recited in claim 4, wherein said coiled conductor is generally cylindrical.

9. The integral electrical circuit controller apparatus as recited in claim 4, wherein said coiled conductor is formed from a nichrome wire.

10. The integral electrical circuit controller apparatus as recited in claim 4, wherein said coiled conductor is formed from an iron wire.

11. The integral electrical circuit controller apparatus as recited in claim 1, wherein said current throttle impedance means is user-modifiable.

12. The integral electrical circuit controller apparatus as recited in claim 5, wherein said base plate further has means for mounting said apparatus on a panel;

said electrical contactor further has at least one line terminal, at least one load terminal, and a front surface facing away from said base plate;

said circuit breaker further has a handle means facing away from said base plate for operating said separable contact means, at least one line terminal, and at least one load terminal, each line terminal of said electrical contactor generally facing each load terminal of said circuit breaker; and said current throttle impedance means further has at least one conductor connected to said at least one line terminal of said contactor and at least one conductor connected to said at least one load terminal of said circuit breaker, said current throttle impedance means mounted to said base plate and located behind at least one of said electrical contactor and said circuit breaker.

13. The integral electrical circuit controller apparatus as recited in claim 12, wherein said circuit breaker further has a rotary handle means for operating said separable contact means.

14. The integral electrical circuit controller apparatus as recited in claim 12, wherein said base plate further has means for mounting said electrical contactor away from said panel so that heat transferred by said current throttle impedance means via said panel to said electrical contactor is minimized.

15. The integral electrical circuit controller apparatus as recited in claim 12, wherein said base plate further has heat transfer means for dissipating heat from said current throttle impedance means.

16. The integral electrical circuit controller apparatus as recited in claim 12, wherein said current throttle impedance means is user-modifiable.

17. The integral electrical circuit controller apparatus as recited in claim 12, wherein said current throttle impedance means comprises a coiled conductor having a resistive and an inductive impedance and a dielectric housing enclosing said coiled conductor.

18. The integral electrical circuit controller apparatus as recited in claim 17, wherein said coiled conductor is generally cylindrical.

19. The integral electrical circuit controller apparatus as recited in claim 17, wherein said coiled conductor is formed from a nichrome wire.

20. The integral electrical circuit controller apparatus as recited in claim 17, wherein said coiled conductor is formed from an iron wire.

* * * * *